US007309139B2

(12) United States Patent
Au et al.

(10) Patent No.: US 7,309,139 B2
(45) Date of Patent: Dec. 18, 2007

(54) FLASHLIGHT

(75) Inventors: Kang Woon Au, Kowloon (HK); Siu Bong Ng, Hong Kong (HK); Wing On Tang, Hong Kong (HK)

(73) Assignee: Eveready Battery Company, Inc., St. Louis, MO (US)

( * ) Notice: Subject to any disclaimer, the term of this patent is extended or adjusted under 35 U.S.C. 154(b) by 146 days.

(21) Appl. No.: 10/943,060

(22) Filed: Sep. 16, 2004

(65) Prior Publication Data

US 2006/0056176 A1 Mar. 16, 2006

(51) Int. Cl.
*F21L 4/04* (2006.01)

(52) U.S. Cl. ..... 362/188; 362/202; 362/285; 362/418

(58) Field of Classification Search ..... 362/188–189, 362/202, 187, 197–199, 203, 285, 287–288, 362/191, 200, 204–206, 208, 289, 418, 429, 362/430, 449, 109–120
See application file for complete search history.

(56) References Cited

U.S. PATENT DOCUMENTS 1,408,528 A 3/1922 Lyhne
1,584,539 A * 5/1926 Hopkins ..... 362/188
1,820,620 A * 8/1931 Jones ..... 362/188
2,125,038 A 7/1938 Tompkins et al.
2,444,107 A 6/1948 Montgomery
3,603,783 A 9/1971 Schwartz
4,527,223 A * 7/1985 Maglica ..... 362/187
5,461,552 A 10/1995 Tillery
6,045,236 A * 4/2000 Cheng et al. ..... 362/188
6,068,386 A * 5/2000 Pastega ..... 362/205
6,174,071 B1 1/2001 Chan
7,001,042 B2 * 2/2006 Maglica ..... 362/202

FOREIGN PATENT DOCUMENTS

FR 2444885 A 8/1980
WO WO 02/066887 A1 8/2002

* cited by examiner

*Primary Examiner*—Sandra O'Shea
*Assistant Examiner*—Bao Q. Truong
(74) *Attorney, Agent, or Firm*—Gregory J. Adams

(57) ABSTRACT

A portable lighting device, such as a flashlight, having a rotatable band disposed around the exterior of the flashlight is disclosed. Rotational movement of the band is converted to lateral movement of the light emitting element within the flashlight. The structural integrity of the flashlight is not compromised when the rotatable band is rotated around the flashlight to adjust the width of the projected pattern of light.

35 Claims, 7 Drawing Sheets

FLASHLIGHT

BACKGROUND OF THE INVENTION

This invention generally relates to flashlights. More particularly, this invention is concerned with flashlights that have a focusing mechanism incorporated therein.

Portable lighting devices, such as flashlights and lanterns, are commercially available in a wide array of embodiments. Some embodiments, such as tubularly shaped flashlights, are required to produce a narrow pattern of light that brightly illuminates a small area that must be closely inspected as well as a broad, less intense pattern of light that illuminates a much larger area. Some flashlights include a mechanism that can be used to change the pattern of light from broad to narrow and from narrow to broad as needed and are commonly known as "focusable lights". Many commercially available focusable lights adjust the size of the projected light beam by rotating the lens cap which is threaded onto one end of the flashlight's housing. The lens cap typically contains the transparent lens through which the light is projected as well as the reflector which directs the light through the lens. As the lens cap is rotated in a first direction around the flashlight's housing, the reflector is moved relative to the light and the lens cap is loosened from the flashlight's housing. Moving the reflector in relation to the light causes the width of the projected light pattern to change. Unfortunately, loosening the lens cap can be detrimental to the operation of the light as well as the safety of the person using the light. For example, a problem can occur if a consumer accidentally removes the lens cap from the flashlight's housing while trying to adjust the focus of the light. If the consumer is in a dark location when the focus of the light must be adjusted and the lens cap is unintentionally and unexpectedly separated from the remaining portion of the housing, the user may drop one or more of the light's components and thus not be able to properly reassemble the batteries and/or components thereby precluding further use of the flashlight. If the unintended disassembly occurs in an environment containing flammable fumes, such as could occur in an underground mine, the light bulb's filament could ignite the fumes if the bulb's glass envelop were broken and its hot filament then contacted the fumes. Another problem can occur if the flashlight is used in an environment where the flashlight may be unintentionally sprayed with water such as when the light is used by a firefighter during the act of extinguishing a fire. Some of the water could flow between the lens cap and the flashlight's housing because the connection between these components had been loosened in order to focus the light. If water accumulates in the portion of the flashlight's housing that contains the batteries, switch and light bulb, the flashlight's performance may deteriorate due to rusting of the battery's terminals or the creation of an electrical short circuit in the switch. Either problem can lead to premature failure of the light. Yet another problem with flashlights that require the consumer to loosen the lens ring in order to adjust the focus of the light is the tendency of the light not to remain at the focused position for an extended period of time because the lens cap and flashlight housing are loosely secured to one another. For example, the lens ring may rotate, relative to the flashlight housing, as the flashlight rolls across a surface or is repeatedly inserted into and removed from a tool pouch. If the focus of the light is accidentally changed, the user must readjust the light's focusing mechanism to achieve the desired light pattern before proceeding with the task at hand.

The present invention provides a flashlight with a focusing mechanism that can be safely used in environments where the flashlight's housing must prevent accidental disassembly and the flashlight's light pattern must be adjustable by the user. The mechanism allows the user to set the focus as needed and then use the light as desired without the flashlight's light pattern inadvertently changing due to a loose connection between the flashlight's components.

In one embodiment, a portable lighting device of the present invention includes a housing, a reflector, a light emitting element and a focusing mechanism. The housing has a first section removably secured to a second section. The first section defines an opening having a light transparent material disposed there across. The second section defines an open ended cavity having at least one battery disposed therein. The first section and the second section define an enclosed cavity. The reflector is securely disposed within the cavity proximate the first section. The light emitting element is movably mounted within the reflector. The focusing mechanism includes a rotatable band disposed around the housing and a means for moving the light emitting element, relative to the reflector, in response to rotational movement of the rotatable band. The rotatable band is connected through the housing to the means for moving the light emitting element.

The present invention also relates to a flashlight that is capable of producing different size light patterns. The flashlight includes a tubularly shaped housing, a reflector, a light and a focusing assembly. The housing, which defines an enclosed cavity, has an exterior surface, a first end and a second end. The first end defines an opening having a light transparent material disposed there across. The reflector is secured within the cavity adjacent the opening in the housing's first end. The light is located within the reflector. The focusing assembly includes a circular, rotatable ring disposed around the exterior of the housing. The rotatable ring contacts a carrier and holder subassembly through the housing. The subassembly moves laterally within the housing in response to rotational movement of the rotatable ring. The subassembly causes the light to move laterally within the reflector thereby altering the size of the light patterns produced by the flashlight.

DETAILED DESCRIPTION OF THE INVENTION

Figure 1:
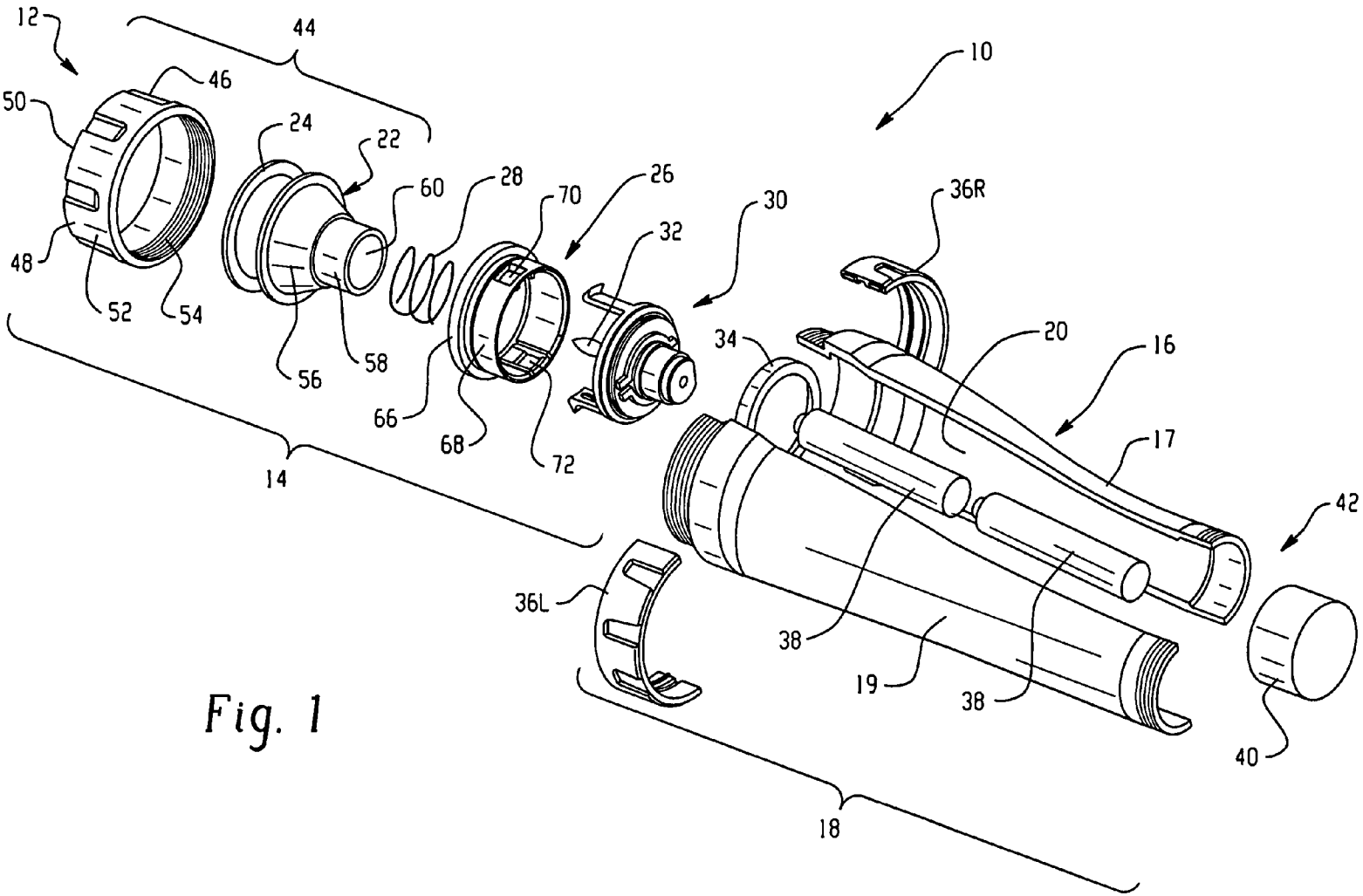
FIG. 1 is an exploded perspective view of a portable lighting device of this invention.

Shown in FIG. 1 is an exploded perspective view of a portable lighting device 10 of this invention which is referred to herein as a flashlight. In this embodiment, the following components are secured to one another. The lighting device's housing includes the outer surfaces of lens cap 42, body housing 16 and end cap 40. Body housing 16 comprises right side body housing 17 and left side body housing 19. Beginning at a first end 12 of the flashlight is a lens cap assembly which is also identified herein as first section 14. The lens cap assembly is removably secured to second section 18. When first section 14 is secured to second section 18, cavity 20 (see FIG. 7) is defined therein. The location at which the first section is secured to the second section may be referred to herein as a junction. Contained within the cavity is reflector 22. The reflector contacts lens 24, retaining member 26 and coiled spring 28. Light holder carrier 30 movably and removably engages retaining member 26 which, in an assembled flashlight, is secured to reflector 22. Light emitting element 32 is located within the bulb holder 31 which is secured to the light holder carrier. Adjustable carrier 34 contacts the light holder carrier and extends through opening 144 (see FIG. 5) in right side body housing 17 thereby engaging the rotatable, focusing ring 36R. Also contained within the cavity are two batteries 38 that provide a source of electrical energy. The batteries are electrically connected to the light emitting element through an electrical circuit that includes an on/off switch (not shown). End cap 40 is secured to the second end 42 of body housing 16.

As shown in FIG. 1, lens assembly 44 includes lens cap 46 and lens 24. Lens cap 46 has a base 48 that defines opening 50 therethrough, and a circular sidewall 52 that depends from the base. The interior surface 54 of sidewall 52 is threaded to facilitate a threaded engagement with second section 18. Lens 24 is a generally flat transparent disc that fits within the lens cap and covers the opening in the lens cap. Reflector 22 abuts lens 24 near the perimeter of the lens. Reflector 22 includes a generally cone shaped portion 56 that abuts tubular portion 58 which defines a centrally located opening 60. Coiled spring 28 contacts an outer surface of cone shaped portion 56 of reflector 22. The inside diameter of coiled spring 28 is slightly larger than the outside diameter of the reflector's tubular portion 58 thereby allowing the spring to easily fit over and around the reflector's tubular portion. Retaining member 26 has a base 66 from which sidewall 68 depends. In an assembled flashlight, retaining member 26 is permanently secured to the reflector. Sidewall 68 defines rectangular openings 70 and 72 therein. The openings are 180° apart.

Figure 2:
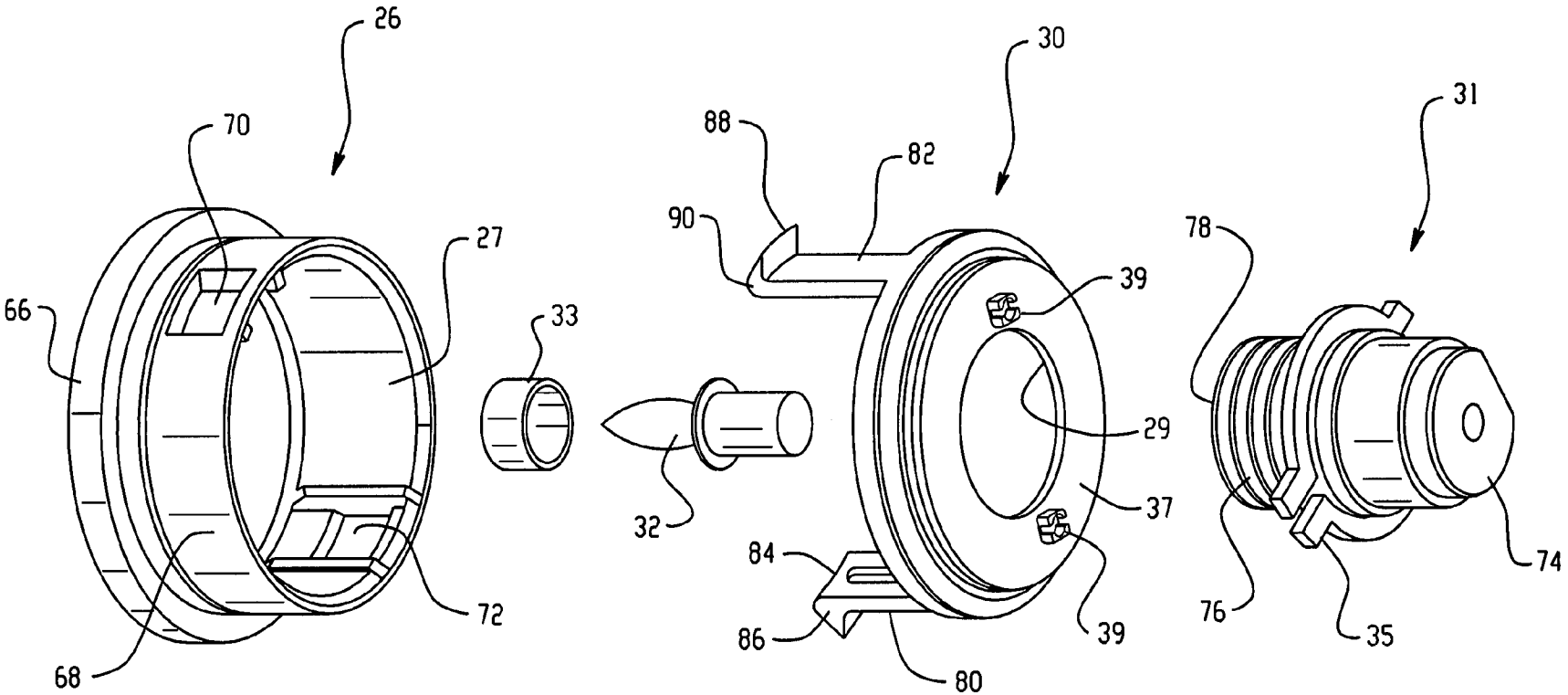
FIG. 2 is a perspective view of a portion of a focusing mechanism used in a lighting device of this invention.

Referring now to FIG. 2, the features of retaining cap 33, light emitting element 32, light holder carrier 30 and bulb holder 31 will now be described. Bulb holder 31 includes a base 74, a circular wall 76 depending perpendicularly from the base and defining cavity 78 therein. Bulb holder 31 includes a snap fit connector 35 that facilitates securely attaching bulb holder 31 to the light holder carrier by forcing snap fit connector 35 into interference fit with detents 39 that are located on the base 37 of light holder carrier 30. Light holder carrier 30 includes first projection arm 80 and second projection arm 82 that extend perpendicularly from base 37 and parallel to one another. The first projection arm 80 has a distal end 84 with a locking structure 86 formed at distal end 84. The second projection arm 82 has a distal end 88 with a locking structure 90 formed at distal end 88. The width and length of each projection arm's distal end and the width and height of openings 70 and 72 defined by the retaining member and with which the distal end will be engaged are coordinated to insure that the distal end of each projection arm, including the locking structure, will readily fit within one of the retaining member's openings. Each locking structure must be able to easily move toward and away from the reflector. The distance which the projection arms can travel is determined by the height of the openings in the retaining member. Retaining cap 33 is a generally cap shaped component with a tubular upstanding wall that abuts a base which defines an opening therethrough. The interior surface of the upstanding wall is threaded. The light emitting element may be an incandescent bulb, a light emitting diode or a fluorescent bulb.

The components shown in FIG. 2 may be assembled as follows. Lamp holder 31 is partially inserted through the opening 29 in base 37 of light holder carrier 30 until snap fit connector 35 abuts the base of the light holder carrier. The snap fit connector is made to forcefully engage detents 39 thereby securing the bulb holder and light carrier to one another. Light emitting element 32 is then inserted into cavity 78. Retaining cap 33 is then threaded onto matching threads located on the exterior surface of the bulb holder's circular wall 76. The retaining cap is designed to allow the light generating portion of the light emitting element to project through the retaining cap while simultaneously securing the light emitting element to the bulb holder. The light holder carrier with the light emitting element and bulb holder secured thereto is then made to engage retaining member 26 by forcing the distal ends of projection arms 80 and 82 to flex toward each other as they contact and slide along the interior surface of retaining member 26 until locking structures 86 and 90 spring outwardly through openings 70 and 72 thereby establishing an interlocking relationship between the light holder carrier and the retaining member. Because the locking structures are narrower than the width of the openings and shorter than the height of the openings, the light holder carrier can easily move toward and away from the base of the retaining member.

Figure 3A:
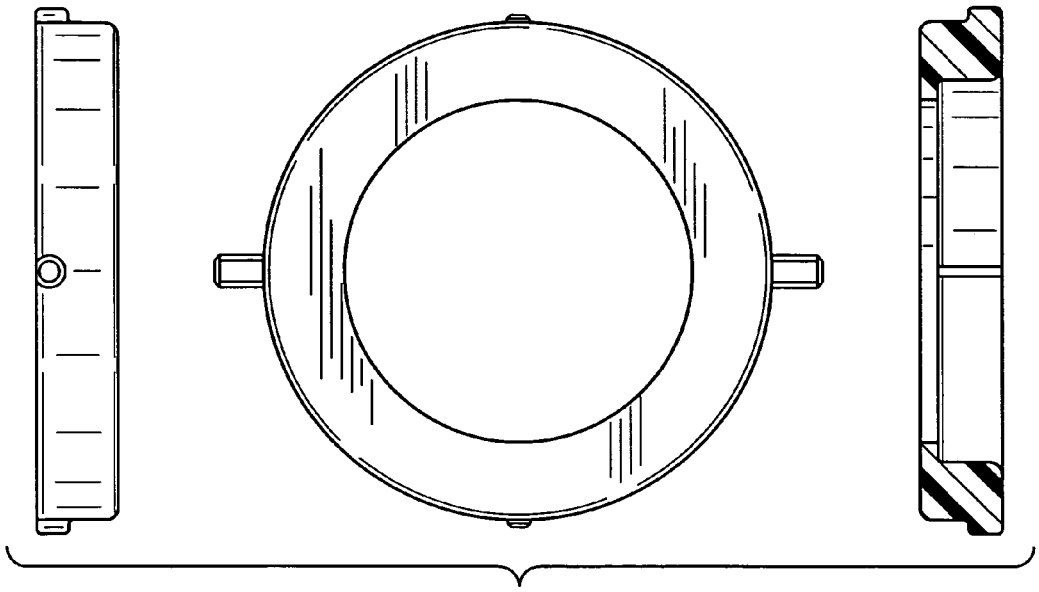
FIGS. 3A, 3B and 3C are three views of an adjustable carrier that is suitable for use in a portable lighting device of this invention.
Figure 3B:
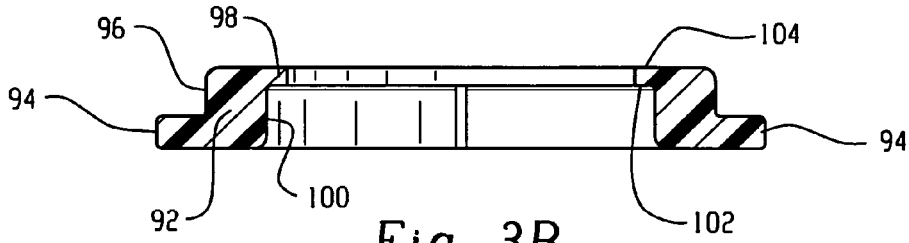
Figure 3C:
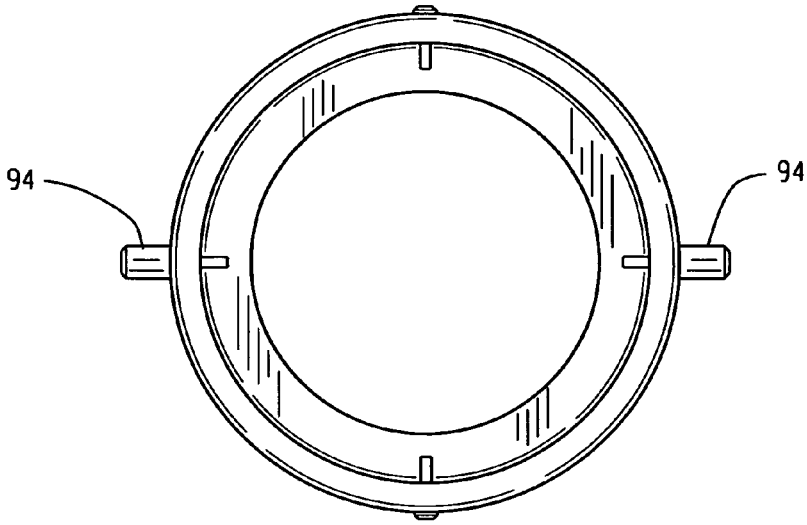

As shown in FIG. 3A, 3B and 3C, adjustable carrier 34 is a circular component with a vertical wall 92 having two projections 94 protruding outwardly and perpendicularly from an outer circumferential edge 96 of the vertical wall and a flange 98 projecting inwardly and perpendicularly from an inner circumferential second edge 100 of the vertical wall. Depending flange 98 has an inner surface 102 that abuts base 104 of light holder carrier 30 when the light is assembled.

Figure 4A:
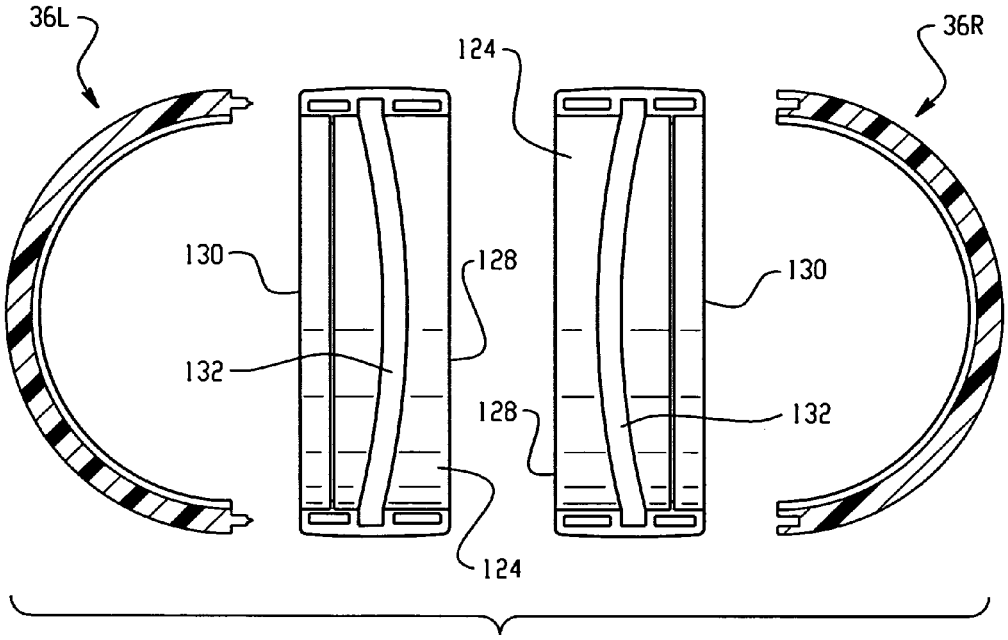
FIG. 4A shows side views and cross-sectional views of a focusing ring.
Figure 4B:
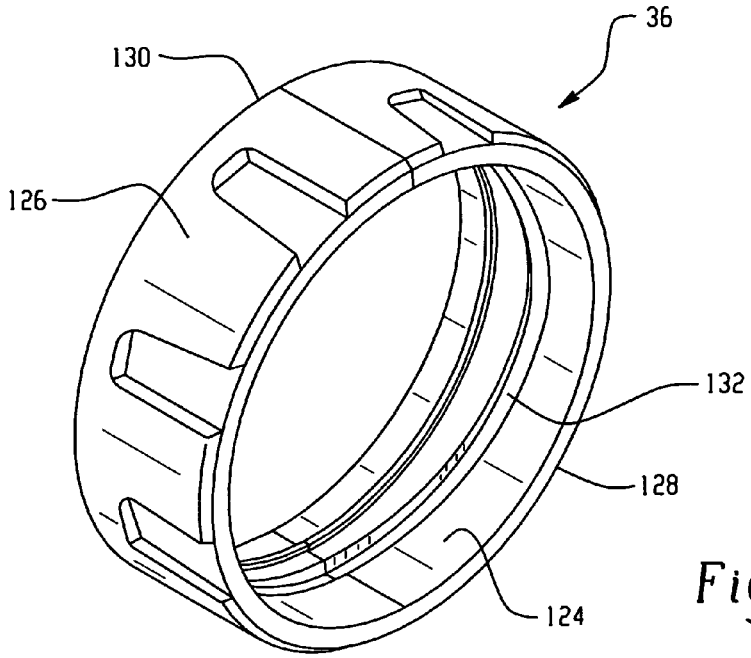
FIG. 4B shows a perspective view of a complete focusing ring.

As shown in FIG. 4A, rotatable ring 36 is made from a right half ring 36R and a left half ring 36L. As shown in FIG. 4B, when half rings 36R and 36L are secured to one another, complete ring 36 is formed. Complete ring 36 may also be referred to herein as a focusing ring, rotatable ring or rotatable band. A groove 132 is formed in the surface of each half ring. The physical dimensions of the grooves in 36R and 36L are identical. In order to form a continuous undulating groove in the inner surface of the focusing ring, the groove in half ring 36L must be a mirror image of the groove in half ring 36L. Focusing ring 36 has an interior surface 124, an exterior surface 126, a first edge 128 and a second edge 130. Groove 132 is formed in the interior surface. The middle of groove 132 is closest to first edge 128 and the ends of groove 132 are closest to and equal distance from the second edge 130. Due to the continuous undulating groove formed on the interior surface of the focusing ring, the width of the projected light pattern can be continuously adjusted by rotating the focusing ring an infinite number of times in either a first (clockwise) direction or a second (counterclockwise) direction. Because rotation of the focusing ring does not loosen the connection between the lens cap and the flashlight's body housing, there is no need to limit the direction nor degree of rotation that the focusing ring can be rotated. If desired, the exterior surface 126 of rotatable ring 36 can be decorated with indicia 99 (see FIG. 6), such as numbers or letters that will allow the user to preset the light's pattern before using the flashlight's switch to complete the electrical circuit thereby providing power to the light emitting element. Each number or letter can be made to correspond to a different position between the light emitting element and the reflector. Furthermore, the exterior surface of the focusing ring may be covered with an outer sleeve (not shown) that will improve the consumer's ability to easily grasp and rotate the focusing ring. The outer sleeve may be made from a pliable material such as a soft rubber.

Figure 5:
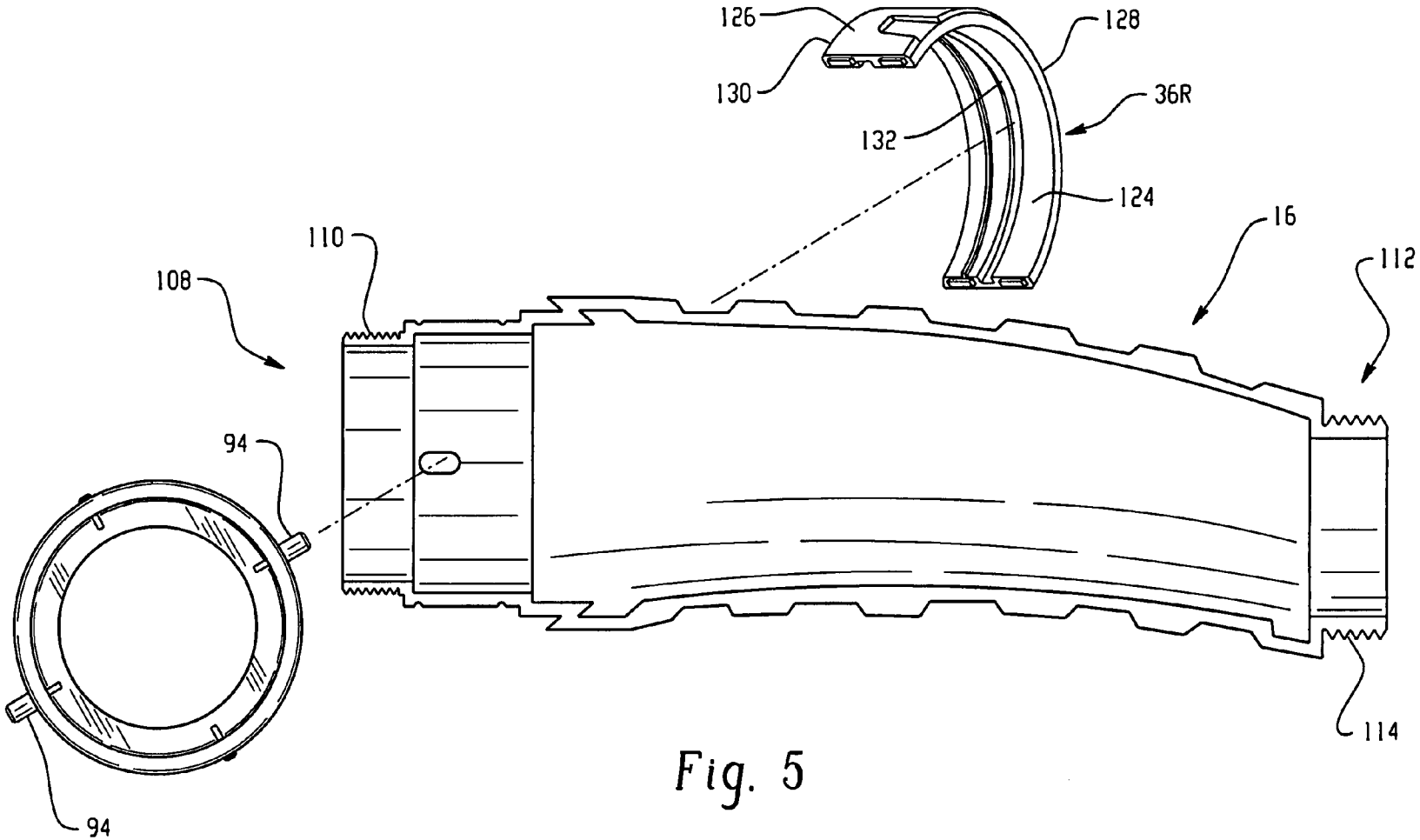
FIG. 5 is a cross-section showing an adjustable carrier, a cross section of a body housing and a focusing ring.

Shown in FIG. 5 is a cross section of right body housing 17. Located at the first end 108 of right body housing 17 are threads 110 that are used to secure the body housing to lens cap 46 thereby forming a junction between the lens cap and body housing. Located at the second end 112 of body assembly 16 are threads 114 that are used to secure end cap 40 to the body assembly.

Figure 6:
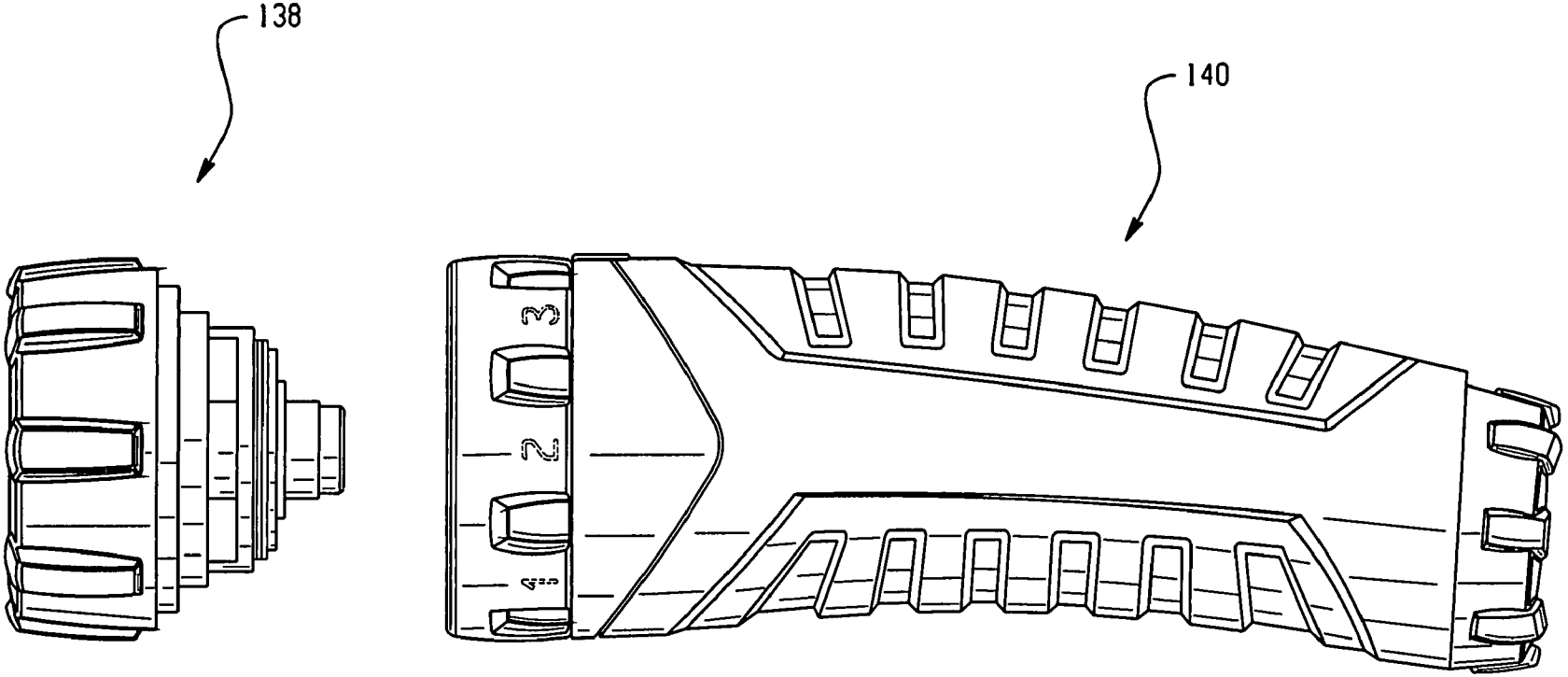
FIG. 6 shows a partially disassembled flashlight of the present invention.

FIG. 6 shows a flashlight of this invention that has been partially disassembled to facilitate replacement of the batteries. In this view, top assembly 138 has been separated from bottom assembly 140 by rotating the top assembly while holding the lower assembly stationary thereby loosening the threaded connection therebetween. The top assembly includes: lens cap, lens, reflector, coiled spring, retaining member, light holder carrier and light emitting element. The bottom assembly includes: batteries, focusing ring, adjustable carrier, body housing and end cap. After the top assembly has been separated from the bottom assembly, the depleted batteries can be removed from the flashlight's cavity and replaced with new batteries. Due to the construction of the flashlight, focusing ring 36 does not need to be rotated during the battery replacement process. Consequently, the batteries can be replaced without adjusting the width of the beam projected by the flashlight. If the consumer has preset the flashlight's focus to provide optimum illumination during a specific activity, and the batteries suddenly stop functioning, the consumer can rapidly replace the batteries without needing to reset the focus before once again using the flashlight.

Figure 7:
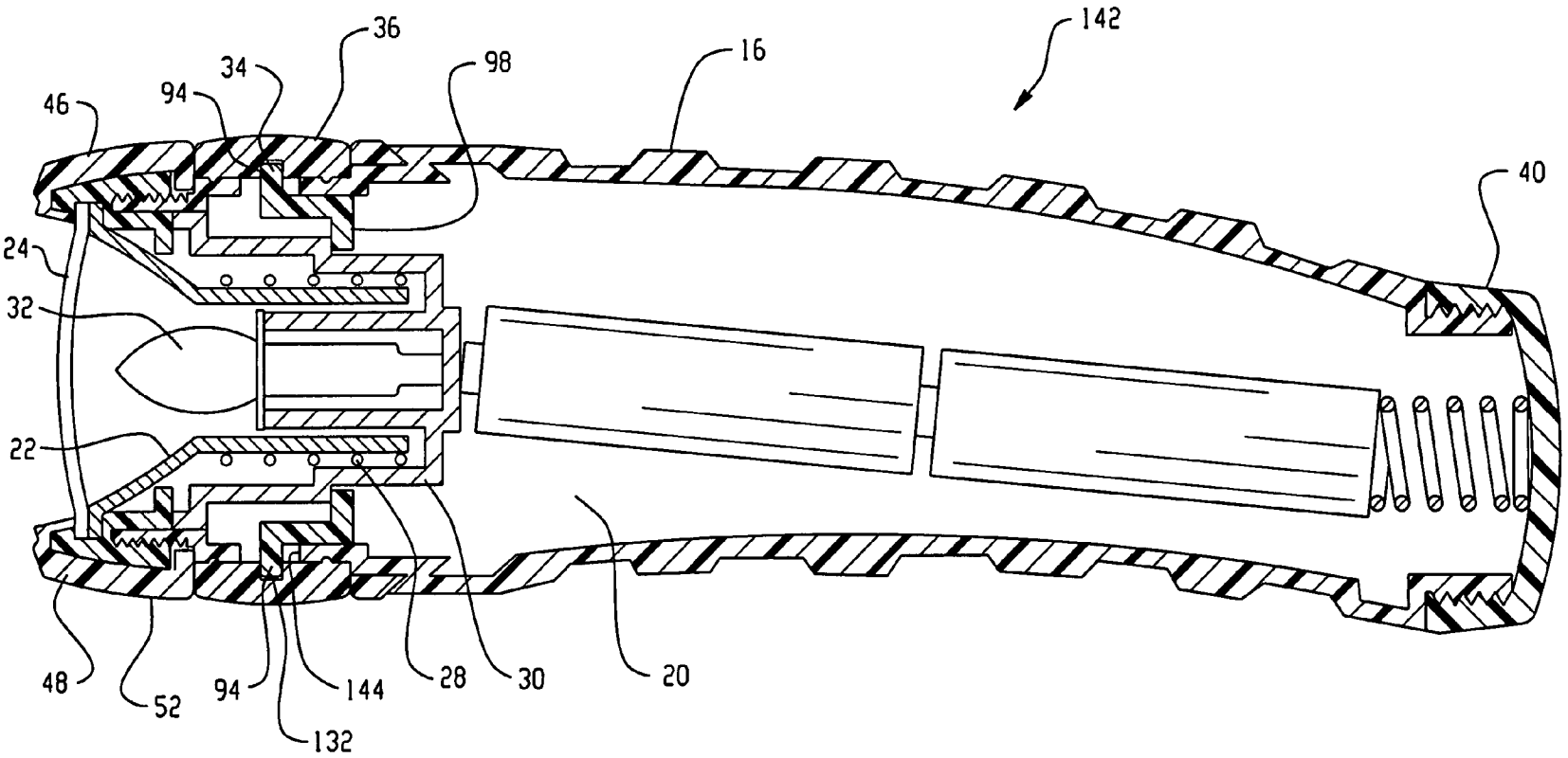
FIG. 7 is a cross-section of an assembled flashlight of this invention.

The operation of an assembled flashlight of this invention will now be explained. Assembled flashlight 142, shown in FIG. 7, can be made to project different size light patterns onto a flat surface located a fixed distance from the flashlight by rotating focusing ring 36 around the perimeter of housing 16. The rotational movement of ring 36 causes relative movement between reflector 22 and the light emitting element 32 by moving the light emitting element within the reflector that is securely positioned in the housing. The rotational movement of the ring is converted into linear movement by the focusing assembly which includes a focusing ring and a means for moving light emitting element 32. The means for moving the light emitting element includes a means for holding a light emitting element, a resilient means and a carrier means. In FIG. 7, the resilient means is coiled spring 28 that is compressed and trapped between reflector 22 and light holder carrier 30. The function of the resilient means is to push the light holder assembly away from the reflector. Other resilient means could include leaf springs or elastomeric components that are configured to constantly displace the light holder carrier away from the reflector. The carrier means disclosed in FIG. 7 is adjustable carrier 34 which simultaneously contacts focusing ring 36 and light holder carrier 30. In the embodiment shown in FIG. 7, the carrier's projections 94 protrude through openings 144 in body housing 16 and engage spiral groove 132 in the interior surface of the focusing ring by fitting within the width of groove 132. The adjustable carrier's flange 98 contacts and supports the base of the light holder carrier thereby counteracting and limiting the coiled spring's ability to force the light holder carrier away from the reflector. While the adjustable carrier embodiment shown in FIGS. 3A, 3B and 3C disclose a wall 92 with two projections 94 and flange 98 depending from the wall, carrier means having other physical configurations are possible provided the carrier means converts rotary movement around the housing to lateral movement within the housing.

The means for holding a light emitting element includes light holder carrier 30 and retaining member 26. The means for holding a light emitting element is assembled by inserting the distal ends, 84 and 88, of the holder's projecting arms, 80 and 82, inside the retaining member's sidewall 64 so that locking structures 86 and 90 forcefully engage openings 70 and 72 by extending partially into and through the openings in the sidewall. The projecting arms are made from a sufficiently flexible material that the arms can be squeezed together to enable insertion of the arms inside the retaining member and the arms will spring back through the openings thereby removeably securing the light holder carrier to the retaining member which is rigidly attached to the reflector that is secured to the housing. The openings in the retaining member are sized to allow the light holder carrier to move linearly toward and away from the reflector to which the retaining member is secured. The linear movement of the light holder carrier, which is also described herein as backward and forward movement of the light holder carrier, results in the light emitting element moving into and out of the reflector's optimum point of focus which causes the width of the flashlight's projected light pattern to change from narrow to broad or from broad to narrow.

When the flashlight is assembled, the adjustable carrier's projections 94 are made to align with and project through two opposing openings 144 in housing 16 thereby enabling the projections to extend into and engage the spiral groove in the focusing ring. When the user rotates the focusing ring around the housing, the spiral groove forces the carrier to move back and forth within the housing. Because the adjustable carrier's inwardly depending flange 98 abuts the base of the light carrier holder, a first rotational movement of the rotatable ring forces the light emitting element to move laterally within the housing toward the reflector. When the rotatable ring is rotated further in the first direction or in a second direction that is opposite to the first direction, the adjustable carrier moves away from the reflector thereby allowing the coiled spring to forcefully bias the holder away from the reflector. As the light emitting element moves within the reflector, the flashlight's projected pattern of light varies from narrow to broad and from broad to narrow. Due to the flashlight's unique design, adjusting the light to provide a broad or narrow pattern of light does not loosen the lens cap from the body housing thereby eliminating the possibility that the flashlight's components may be suddenly and unexpectedly separated from one another.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the Doctrine of Equivalents.

We claim:

1. A portable lighting device, comprising:

(a) a housing having a first section removably secured to a second section, said first section defines an opening having a light transparent material disposed thereacross, said second section defining an open ended cavity having at least one battery disposed therein, said first section removably secured to and over the open end of said second section thereby forming an enclosed cavity;

(b) a reflector securely disposed within said cavity proximate said first section;

(c) a light emitting element movably mounted within said reflector; and (d) a focusing assembly comprising a rotatable band disposed around said housing and a means for moving said light emitting element, relative to said reflector, in response to rotational movement of said rotatable band, said rotatable band connected to said means through said housing.

2. The portable lighting device of claim 1, wherein said first section is secured to said second section at a rotatable junction and said rotatable band is disposed over said junction.

3. The portable lighting device of claim 1, wherein said means for moving said light emitting element comprises a means for holding said light emitting element, a resilient means for physically biasing said light emitting element relative to said reflector, and a carrier means simultaneously contacting said rotatable band and said means for holding said light emitting element, said carrier means converting rotational movement of said rotatable band into lateral movement of said means for holding said light emitting element.

4. The portable lighting device of claim 3, wherein said rotatable band comprises an inner surface having a groove formed therein, said carrier means engages said groove whereby rotation of said rotatable band forces said carrier means to move laterally relative to said reflector.

5. The portable lighting device of claim 3, wherein said resilient means forces said light emitting element away from said reflector.

6. The portable lighting device of claim 3, wherein said resilient means is a coiled spring.

7. The portable lighting device of claim 3, wherein said means for holding a light emitting element comprises a light holder carrier having a base, at least one projection extending from said base, said projection having a locking means formed thereon.

8. The portable lighting device of claim 7, wherein said projection has a distal end and said locking means is formed at said distal end.

9. The portable lighting device of claim 7, wherein said focusing assembly further comprises a retaining member secured to said reflector, said retaining member comprises a wall depending from said reflector and defining at least one opening therein, said projection's locking means engaging the opening in said retaining member thereby establishing and maintaining an interlocking relationship between said projection and said retaining member.

10. The portable lighting device of claim 9, wherein said opening in said retaining member is sized to allow said projection's locking means to slideably move within said opening thereby allowing said means for holding a light emitting element to move relative to said reflector.

11. The portable lighting device of claim 1, wherein said light emitting element is selected from the group consisting of: an incandescent bulb, a fluorescent bulb and a light emitting diode.

12. The portable lighting device of claim 11, wherein said light emitting element is an incandescent bulb.

13. The portable lighting device of claim 4, wherein said carrier means comprises a circular wall, two projections and a flange, said circular wall having a top edge, a bottom edge, an inner surface and an outer surface, said projections abutting the wall's top edge and projecting perpendicularly from the circular wall's outer surface, said flange abutting said wall's bottom edge and projecting perpendicularly from the circular wall's inner surface, said projections engaging said rotatable band's groove, said flange contacting said means for holding a light emitting element.

14. The portable lighting device of claim 1, wherein said first section comprises a light transparent lens through which light from the light emitting element passes.

15. The portable lighting device of claim 1, wherein said rotatable band comprises an outer surface having indicia disposed thereon, said indicia indicating the position of said light emitting element relative to said reflector.

16. The portable lighting device of claim 1, wherein said rotatable band can be rotated an infinite number of times in a first direction.

17. The portable lighting device of claim 1, wherein said rotatable band can be rotated an infinite number of times in both a first direction and a second direction.

18. The portable lighting device of claim 1, wherein rotation of said rotatable band in either a first direction or a second direction provides a projected pattern of light that oscillates from narrow to broad and broad to narrow.

19. The portable lighting device of claim 9, wherein said retaining member comprises at least two openings in said wall, said means for holding a light emitting element comprises at least two projections, each projection having a distal end with a locking means formed thereon, wherein said at least two projection's locking means each engage a separate opening in said retaining member.

20. The portable lighting device of claim 1, wherein said device is a flashlight.

21. A flashlight capable of producing different size light patterns, comprising:

(a) a tubularly shaped housing defining an enclosed cavity, said housing having an exterior surface, a first end, and a second end, said first end defining an opening having a light transparent material disposed there across;

(b) a reflector secured within said cavity and adjacent said opening in said housing's first end;

(c) a light located within an opening defined by said reflector; and (d) a focusing assembly comprising a circular, rotatable ring disposed around the exterior of said housing, said rotatable ring contacting a carrier and holder subassembly through said housing, said subassembly moving laterally within said housing in response to rotational movement of said rotatable ring, said subassembly causing said light to move laterally within said reflector thereby altering the size of the light pattern produced by said flashlight.

22. The flashlight of claim 21, wherein said circular rotatable ring completely encircles said housing.

23. The flashlight of claim 21, wherein said rotatable ring can be rotated an infinite number of times in a first direction.

24. The flashlight of claim 21, wherein said rotatable ring can be rotated an infinite number of times in both a first direction and a second direction.

25. The flashlight of claim 21, wherein rotation of said rotatable ring in either a first direction or a second direction provides a projected pattern of light that oscillates from narrow to broad and broad to narrow.

26. The flashlight of claim 21, wherein said housing has a first section removably secured to a second section at a junction.

27. The flashlight of claim 26, wherein said rotatable ring encircles said housing at said junction.

28. The flashlight of claim 21, wherein said subassembly comprises an adjustable carrier and a light holder carrier, said adjustable carrier contacting both said light holder carrier and said rotatable ring.

29. The flashlight of claim 21, wherein said flashlight further comprises a retaining member secured to said reflector, said retaining member comprises a circular wall depending from said reflector and defining at least one opening therein; said holder comprising a base, a bulb holder and at least one projection extending from said base, said projection extending perpendicular to said base and having a distal end with a locking means formed at said distal end wherein said locking means engages the opening in said retaining member, said opening sized to allow said projection's locking means to slideably move within said opening thereby allowing said holder to move relative to said reflector.

30. The flashlight of claim 29, wherein said reflector defines a centrally located opening and said light is located within said reflector's opening.

31. The flashlight of claim 29, wherein said locking means moves toward and away from said reflector.

32. The portable lighting device of claim 1, wherein said first section remains stationary relative to said housing during rotation of said rotatable band.

33. A portable lighting device, comprising:

(a) a housing having a first section removably secured to a second section, said first section defines an opening having a light transparent material disposed thereacross, said second section defining an open ended cavity, said first section removably secured to and over the open end of said second section thereby forming an enclosed cavity;

(b) a reflector securely disposed within said cavity proximate said first section;

(c) a light emitting element movably mounted within said reflector; and (d) a focusing assembly comprising a rotatable band disposed around said housing for moving said light emitting element, relative to said reflector, in response to rotational movement of said rotatable band.

34. The portable lighting device of claim 1, wherein said rotatable band surrounds a perimeter of said housing.

35. The portable lighting device of claim 1, wherein said rotatable band rotates around an outer surface of a perimeter of said housing.

* * * * *